US009230783B2

(12) United States Patent
Duffy et al.

(10) Patent No.: US 9,230,783 B2
(45) Date of Patent: Jan. 5, 2016

(54) CLAMPED CATHODE POWER SUPPLY FOR IMAGE INTENSIFIER

(75) Inventors: Keira Alyse Duffy, Northampton, MA (US); James Hoge Bowen, Salem, VA (US); David Geer Fletcher, Simsbury, CT (US); William Eric Garris, Salem, VA (US); Ransom Hal Castleberry, Blacksburg, VA (US)

(73) Assignee: EXELIS, INC., McLean, VA (US)

( * ) Notice: Subject to any disclaimer, the term of this patent is extended or adjusted under 35 U.S.C. 154(b) by 794 days.

(21) Appl. No.: 13/535,629

(22) Filed: Jun. 28, 2012

(65) Prior Publication Data

US 2014/0001967 A1 Jan. 2, 2014

(51) Int. Cl.

| | |
|---|---|
| ***H01J 40/14*** | (2006.01) |
| ***H01J 29/98*** | (2006.01) |
| *H01J 31/50* | (2006.01) |

(52) U.S. Cl.

CPC ..... *H01J 40/14* (2013.01); *H01J 29/98* (2013.01); *H01J 31/507* (2013.01)

(58) Field of Classification Search

CPC ..... H01J 31/50; H01J 31/507; H01J 29/98; H01J 40/14

See application file for complete search history.

(56) References Cited

U.S. PATENT DOCUMENTS

| | | | | |
|---|---|---|---|---|
| 4,195,222 | A * | 3/1980 | Fouilloy | 250/214 VT |
| 4,882,481 | A * | 11/1989 | Gilligan et al. | 250/214 VT |
| 5,146,077 | A | 9/1992 | Caserta et al. | |
| 5,336,881 | A * | 8/1994 | Caserta et al. | 250/214 VT |
| 5,402,042 | A * | 3/1995 | Madsen | 315/174 |
| 5,656,808 | A * | 8/1997 | Marche et al. | 250/214 VT |
| 5,942,747 | A * | 8/1999 | Saldana | 250/214 VT |
| 6,140,628 | A * | 10/2000 | Sontag et al. | 250/207 |
| 6,278,104 | B1 * | 8/2001 | Saldana et al. | 250/214 VT |
| 6,429,416 | B1 * | 8/2002 | Porter | 250/214 VT |
| 7,696,462 | B2 * | 4/2010 | Saldana | 250/207 |
| 2013/0320192 | A1 * | 12/2013 | Saldana | 250/207 |
| 2014/0001344 | A1 * | 1/2014 | Lewis | 250/214 LA |

* cited by examiner

*Primary Examiner* — Thomas J Hiltunen
(74) *Attorney, Agent, or Firm* — Cantor Colburn LLP

(57) ABSTRACT

A power supply for an image intensifier, the power supply including a DC voltage source generating a photocathode voltage; a bright source protection (BSP) resistor in series with the DC voltage source; and an oscillator in parallel with the DC voltage source and the BSP resistor, the oscillator providing an AC voltage component, the AC voltage component having a fixed pulse width, the AC voltage component being coupled to the photocathode by a diode, the pulse width and shape of the AC voltage component on the photocathode being determined by the photocathode current.

13 Claims, 2 Drawing Sheets

CLAMPED CATHODE POWER SUPPLY FOR IMAGE INTENSIFIER

BACKGROUND OF THE INVENTION

Embodiments relate generally to a power supply for image intensifiers, and more particularly to a clamped cathode power supply for an image intensifier that provides improved bright source resolution.

Image intensifiers are well known for their ability to enhance night-time vision. The image intensifier amplifies the incident light received by it to produce a signal that is bright enough for presentation to the eyes of a viewer. These devices, which are particularly useful for providing images from dark regions, have both industrial and military application. The U.S. military uses image intensifiers during night-time operations for viewing and aiming at targets that otherwise would not be visible. Low intensity visible spectrum radiation is reflected from a target, and the reflected energy is amplified by the image intensifier. As a result, the target is made visible without the use of additional light. Other examples include using image intensifiers for enhancing the night vision of aviators, for providing night vision to sufferers of retinitis pigmentosa (night blindness), and for photographing astronomical bodies.

FIG. 1 depicts an exemplary image intensifier 10. A typical image intensifier 10 includes an objective lens 12, which focuses visible and infrared radiation (collectively referred to herein as light) from a distant object onto a photocathode 14. The photocathode 14, a photoemissive semiconductor heterostructure that is extremely sensitive to low-radiation levels of light in the 580-900 nm spectral range, provides a spatially coherent emission of electrons in response to the electromagnetic radiation. Electrons emitted from the photocathode 14 are accelerated towards the input of the microchannel plate (MCP) 20. The MCP 20 amplifies the incident electrons in a spatially coherent manner. Electrons emerging from the output of the MCP 20 are accelerated toward the phosphor screen 16 (anode), which is maintained at a higher positive potential than the output of the MCP 20. The phosphor screen 16 converts the emitted electrons into visible light. An operator views the visible light image provided by the phosphor screen through an eyepiece 18.

Amplification of the ambient light incident on the image intensifier is achieved by placing an MCP 20 between the photocathode 14 and phosphor screen 16. The MCP 20 is a thin glass plate having an array of microscopic holes through it used to increase the density of the electron emission. Electrons impinging on interior sides of the holes through the MCP 20 result in the emission of a number of secondary electrons each of which, in turn, causes the emission of more secondary electrons. Thus, each microscopic hole acts as a channel-type secondary emission electron multiplier having a gain of up to ten thousand. The electron gain of the MCP 20 is controlled primarily by the potential difference between its input and output planes. A power source 22 applies power to the photocathode 14, the MCP 20 and the phosphor screen 16.

There are several methods used to extend the useful range of night vision intensifiers to and beyond light levels of approximately $10^{-1}$ footcandles. These methods modify the voltage of the cathode relative to the input of the MCP (cathode voltage) in response to input light levels.

The simplest method reduces the effective DC potential of the cathode. This is achieved by placing a high value resistor (Bright Source Protection, BSP) in series between the cathode DC power supply and the cathode. The voltage drop caused by cathode current flowing through the BSP reduces the cathode voltage and thereby reduces the accelerating potential between the cathode and the MCP. The reduced accelerating potential reduces the MCP input current somewhat.

In addition to modifying the DC potential of the cathode, some night vision intensifier power supplies impose AC signals on the cathode as well. The AC signals alternately drive the cathode into and out of conduction, reducing the MCP gain by reducing the effective input current at high light levels. Two types of AC modulation of the cathode are in common use. These are AC clamping and autogating.

Existing AC clamping of the cathode consists of superimposing a half wave rectified sinusoid on the cathode. The sinusoid is referenced to the MCP input and is coupled to the cathode of the intensifier through a diode. The anode of the diode is connected to the cathode of the intensifier. Under high light conditions the cathode of the intensifier is driven with a negative going half wave rectified sinusoid. The sinusoid is typically between 25V peak and 50V peak and 10 KHz and 50 KHz.

Autogating consists of superimposing a duty cycle modulated pulsed waveform on the cathode. The pulse waveform is referenced to the MCP input and is often capacitivly coupled to the intensifier cathode. The autogating waveform on the cathode alternately enables and disables cathode conduction. The autogating duty cycle is controlled by and responds to the light level. Increasing light levels actively reduce the conduction time of the image intensifier, thus reducing the input current and allowing use at higher light levels.

There are drawbacks to both methods of extending the useful range of night vision intensifiers. The existing AC clamping technique is straightforward to apply but extends the useful range by a minimal amount. Autogating does extend the useful range of image intensifiers by an order of magnitude or greater, but requires active electronics to sense the light level and modulate the duty cycle.

While there are methods to extend image intensifier performance in high light environments, further improvements in high light resolution of image intensifiers would be well received in the art

BRIEF SUMMARY OF THE INVENTION

An exemplary embodiment is a power supply for an image intensifier, the power supply including a DC voltage source generating a photocathode voltage; a bright source protection (BSP) resistor in series with the DC voltage source; and, an oscillator in parallel with the DC voltage source and the BSP resistor, the oscillator providing an AC voltage component, the AC voltage component having a fixed pulse width, the AC voltage component being coupled to the photocathode by a diode, the pulse width and shape of the AC voltage component on the photocathode being determined by the photocathode current.

Another exemplary embodiment is an image intensifier including a photocathode; a microchannel plate; a phosphor screen; and a power supply including: a DC voltage source generating a photocathode voltage; a bright source protection (BSP) resistor in series with the DC voltage source; and an oscillator in parallel with the DC voltage source and the BSP resistor, the oscillator providing an AC voltage component, the AC voltage component having a fixed pulse width, the AC voltage component being coupled to the photocathode by a diode, the pulse width and shape of the AC voltage component on the photocathode being determined by the photocathode current.

DETAILED DESCRIPTION

Figure 1:
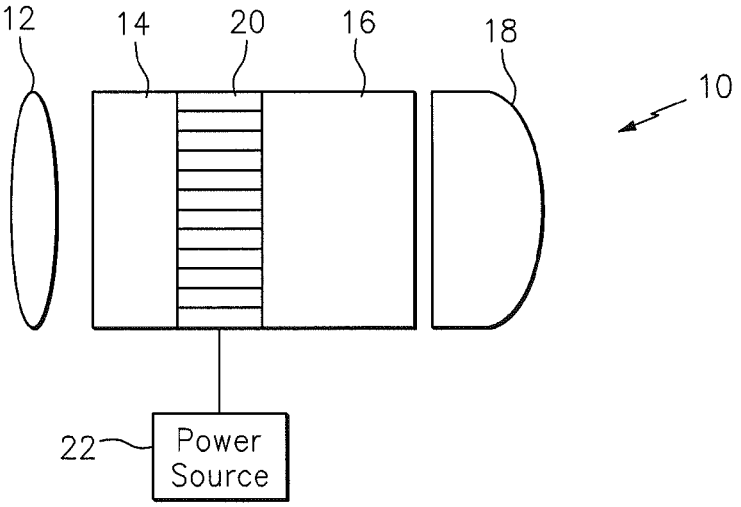
FIG. 1 depicts an exemplary image intensifier.
Figure 2:
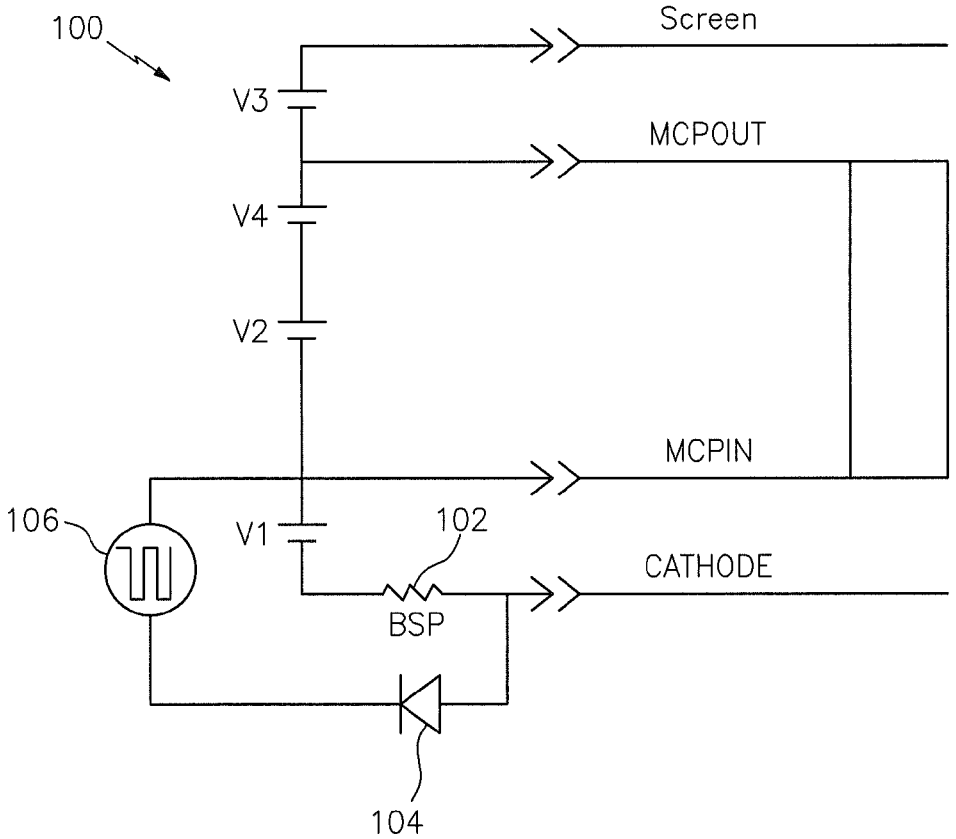
FIG. 2 depicts a power supply for use with an image intensifier.

FIG. 2 depicts a power supply 100 for use with an image intensifier, such as that shown in FIG. 1. Power supply 100 includes three voltage sources, referenced as V1, V2, and V3. V4 is the reference voltage between the negative end of V3 and the positive end of V2. V3 is applied to phosphor screen 16, is positive with respect to V4, and may be on the order of +4000 volts DC. V2 is applied across the MCP 20, is negative with respect to V4, and may be on the order of −800 to −1100 volts DC. V1 is applied to the photocathode 14, is negative with respect to V2, and may be on the order of −600 volts DC relative to V2, which corresponds to −1400 to −1700 volts DC relative to V4 in this example. Oscillator 106 varies between 0V and −a negative voltage relative to V2. The oscillator voltage may be in the order of −200V relative to V2. It is understood that these values are exemplary, and may vary in different embodiments.

Power supply 100 includes a bright source protection (BSP) resistor 102 in series between photocathode 14 and DC voltage source V1. In parallel with DC voltage source V1 and BSP resistor 102 are a diode 104 and an oscillator 106. As described in further detail herein, as increasing light impinges on photocathode 14, increasing cathode current, roughly proportional to light level, flows through BSP resistor 102, thereby decreasing the effective cathode voltage relative to the MCP input due to the resistive voltage drop in BSP resistor 102. At low light levels and cathode currents, diode 104 is biased off continuously since its anode is always more negative than its cathode. As the light level and hence cathode current increases, diode 104 starts to be biased into a conductive state when its anode becomes positive relative to its cathode. This occurs when the DC voltage on the image intensifier cathode decreases sufficiently due to the DC voltage drop in BSP resistor 102 to slightly exceed the negative peaks of the oscillator 106 waveform. Oscillator 106 is operational continuously and generates a fixed amplitude, fixed frequency and fixed pulse width waveform (referred to herein as an AC voltage component). When the negative component of the AC voltage generated by oscillator 106 is more negative than the DC voltage on the image intensifier cathode, diode 104 conducts and adds an AC component to the DC voltage component of V1 which is applied to photocathode 14. During the positive component of the AC voltage generated by oscillator 106, diode 104 is biased off. While diode 104 is biased off, the voltage on the photocathode is determined by the photocathode current only. While diode 104 is biased off, if diode 104 conducted during the previous negative component of the oscillator 106, the photocathode current will charge the photocathode toward its nominal DC value with a waveform determined by the photocathode current only. The frequency, amplitude and pulse width of the AC voltage component from oscillator 106 remains constant through various brightness conditions. The AC voltage component of the photocathode differs from the AC voltage component of the oscillator 106 due to the presence of diode 104. The AC voltage component of the photocathode varies in response to the photocathode current only, such that a higher photocathode current results in a narrower pulse width in the photocathode voltage.

Figures 3A, 3B, 3C, 3D, 3E:
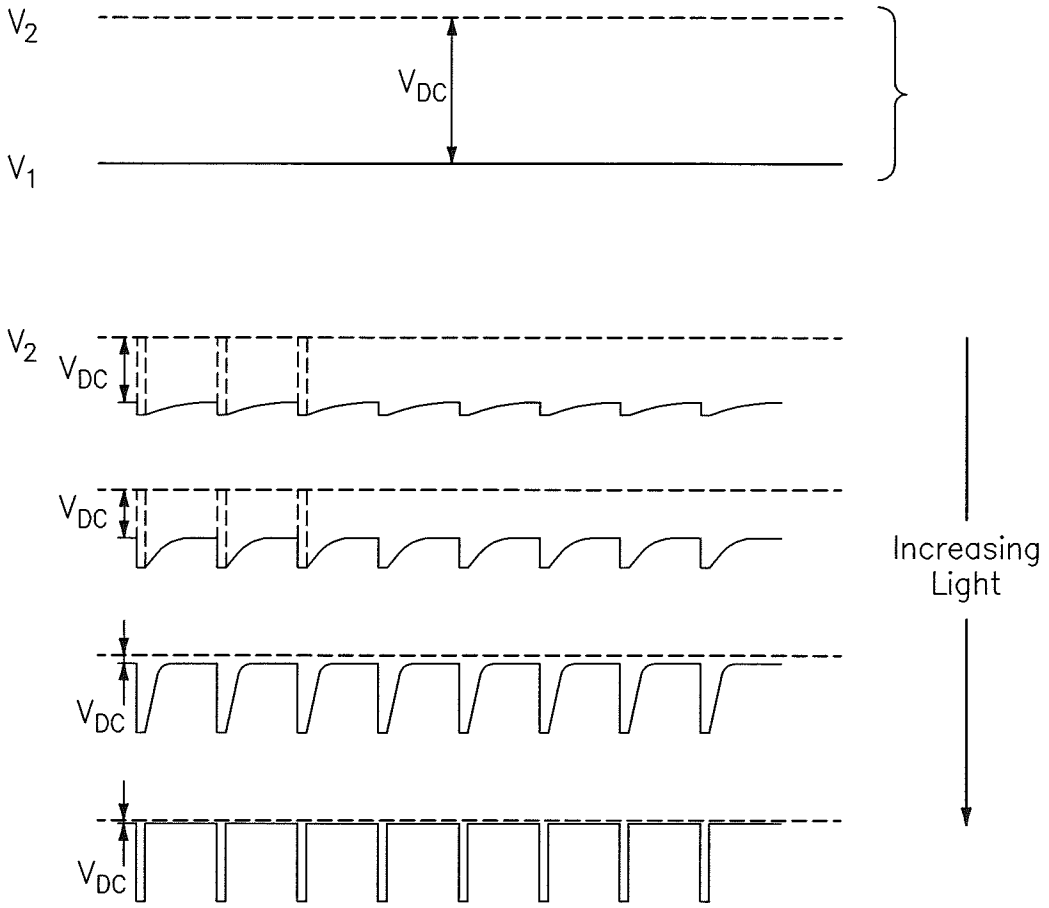
FIGS. 3A-3E depict waveforms of photocathode voltage under different exemplary operating conditions.

Operation of the power supply 100 is described with reference to FIGS. 3A-3E. FIG. 3A depicts voltages V1 and V2 under low light conditions. In this mode, the photocathode current is small, resulting in a small voltage drop over BSP resistor 102. Diode 104 is non-conducting, and the photocathode voltage V1 is at a voltage level, $V_{DC}$, relative to the MCP voltage, V2.

Referring to FIG. 3B, as light impinging on the photocathode 16 increases, the photocathode current increases which causes a larger voltage drop over BSP resistor 102. The photocathode voltage is V1 less the voltage dropped across the BSP resistor 102. When the photocathode voltage reaches the negative peak of the oscillator 106, diode 104 is biased into a conducting state. When the oscillator 106 switches back to its positive state, diode 104 does not conduct. The photocathode current causes photocathode voltage V1 to charge back toward V2, reducing $V_{DC}$. The recharge waveform is determined primarily by the photocathode current and the capacitance present at the photocathode. In FIG. 3B, the photocathode current is relatively small, causing the AC voltage component of the photocathode to have a wide pulse width. The wide pulse width is due to the low photocathode current. Higher photocathode current results in a faster recharge rate and a narrower pulse width of the AC voltage component of the photocathode. The amplitude of the pulses is small since the oscillator negative voltage is only slightly lower than the photocathode DC voltage.

FIG. 3C depicts increasing light on the photocathode 106 relative to FIG. 3B. As shown in FIG. 3C, V1 is shifted closer to V2, due to the increased voltage drop over BSP resistor 102. The pulse width of the AC voltage component of the photocathode is narrower than that shown in FIG. 3B due to the increased photocathode current. The amplitude of the AC component of the photocathode voltage is higher than that shown in FIG. 3B due to the increased difference between the oscillator negative voltage and the cathode DC voltage.

FIG. 3D depicts increasing light on the photocathode 106 relative to FIG. 3C. In this mode, the voltage drop over BSP resistor 102 is sufficient to shift photocathode DC voltage, V1 to equal the MCP voltage, V2. If there were no AC component of cathode voltage, the photocathode would be effectively shut off in this condition. However, the photocathode is periodically driven into conduction by the AC component of the photocathode voltage generated by the oscillator 106 coupled through the diode 104. The pulse width of the AC component of the photocathode voltage is narrower than that shown in FIG. 3C due to the increased photocathode current. The amplitude of the AC component of the photocathode voltage is approximately equal to that of the oscillator 106 due to the DC voltage of the photocathode being approximately V2. However, the AC component drives the photocathode into conduction for a portion of the time and thereby reduces the effective photocathode current and improving the performance of the intensifier at high light conditions. The net time during which the cathode is driven into conduction is determined by the recharge time of the cathode waveform which in turn is determined by photocathode current alone.

FIG. 3E depicts increasing light on the photocathode 106 relative to FIG. 3D. This mode is similar to that in FIG. 3D, with the photocathode voltage V1 is approximately equal to equal V2. The photocathode current is higher than that shown in FIG. 3D. Thus the pulse width of the AC component of the photocathode voltage is even lower than that shown in FIG. 3D. As described with reference to FIG. 3D, the photocathode is driven to a conducting state with each pulse, and then naturally decays to a non-conducting state in response to light impinging on the photocathode 106.

In the exemplary embodiments described above, the diode 104 conducts when the AC voltage is negative with respect to the instantaneous voltage on the photocathode and does not conduct when the AC voltage is positive with respect to the instantaneous voltage on the photocathode. The instantaneous voltage on the photocathode is determined by the cathode current, the DC voltage source, the voltage drop across the BSP resistor and the AC voltage source when the diode is conducting.

Embodiments of the invention offer improved high light resolution over presently used clamped cathode technology by providing the AC voltage component to the photocathode with reduced pulse width, lower frequency and higher amplitudes at higher light intensity. The diode coupled cathode AC voltage component is configured to drive the photocathode of a night vision image intensifier tube from non-conducting back into the conducting state, but does not drive the photocathode back into the non-conducting state. Thus, the photocathode returns to the non-conducting state passively through the action of the photocathode current. The photocathode current is directly related to the amount of light falling on the photocathode of the associated night vision intensifier tube, therefore, the on-time of the photocathode under high light conditions is determined by the light level. No active sensing of photocathode current is required While the invention has been described with reference to exemplary embodiments, it will be understood by those skilled in the art that various changes may be made and equivalents may be substituted for elements thereof without departing from the essential scope thereof. Therefore, it is intended that the invention not be limited to the particular embodiments disclosed for carrying out the invention, but that the invention will include all embodiments falling within the scope of the appended claims.

What is claimed is:

1. A power supply for an image intensifier, the power supply comprising:

a DC voltage source generating a photocathode voltage;

a bright source protection (BSP) resistor in series with the DC voltage source; and an oscillator in parallel with the DC voltage source and the BSP resistor, the oscillator providing an AC voltage component, the AC voltage component having a fixed pulse width, the AC voltage component being coupled to the photocathode by a diode, the pulse width and shape of the AC voltage component on the photocathode being determined by the photocathode current.

2. The power supply of claim 1 wherein:

the anode of the diode is connected to the photocathode and the cathode of the diode is connected to the oscillator.

3. The power supply of claim 1 wherein:

frequency of the AC voltage component is fixed.

4. The power supply of claim 1 wherein:

amplitude of the AC voltage component is fixed.

5. The power supply of claim 1 wherein:

frequency and amplitude of the AC voltage component are fixed.

6. The power supply of claim 5 wherein:

frequency, amplitude and pulse width of the AC voltage component are factory configurable.

7. The power supply of claim 6 wherein:

a discharge rate of the photocathode under low light situations is less than a re-charge rate supplied by the power supply and the discharge rate of the photocathode under high light conditions is greater than the re-charge rate supplied by the power supply.

8. An image intensifier comprising:

a photocathode;

a microchannel plate;

a phosphor screen; and a power supply including:

a DC voltage source generating a photocathode voltage;

a bright source protection (BSP) resistor in series with the DC voltage source; and an oscillator in parallel with the DC voltage source and the BSP resistor, the oscillator providing an AC voltage component, the AC voltage component having a fixed pulse width, the AC voltage component being coupled to the photocathode by a diode, the pulse width and shape of the AC voltage component on the photocathode being determined by the photocathode current.

9. The image intensifier of claim 8 wherein:

the anode of the diode is connected to the photocathode and the cathode of the diode is connected to the oscillator.

10. The image intensifier of claim 8 wherein:

frequency of the AC voltage component is fixed.

11. The image intensifier of claim 8 wherein:

amplitude of the AC voltage component is fixed.

12. The image intensifier of claim 8 wherein:

frequency, amplitude and duty cycle of the AC voltage component are fixed.

13. The image intensifier of claim 12 wherein:

frequency, amplitude, and pulse width of the AC voltage component are factory configurable.

* * * * *